US008414226B2

(12) United States Patent
Skarbövig

(10) Patent No.: US 8,414,226 B2
(45) Date of Patent: Apr. 9, 2013

(54) MINE SUPPORT GROUT BAGS AND GROUT PACKS

(76) Inventor: Nils Mittet Skarbövig, Vredenburg (ZA)

( * ) Notice: Subject to any disclaimer, the term of this patent is extended or adjusted under 35 U.S.C. 154(b) by 0 days.

(21) Appl. No.: 12/739,603

(22) PCT Filed: Sep. 29, 2008

(86) PCT No.: PCT/IB2008/002554

§ 371 (c)(1),
(2), (4) Date: Apr. 23, 2010

(87) PCT Pub. No.: WO2009/053797

PCT Pub. Date: Apr. 30, 2009

(65) Prior Publication Data

US 2010/0247249 A1 Sep. 30, 2010

(30) Foreign Application Priority Data

Oct. 24, 2007 (ZA) ..... 2007/09157

(51) Int. Cl.
*E21D 15/02* (2006.01)

(52) U.S. Cl. ..... 405/288; 405/289

(58) Field of Classification Search ..... 405/288, 405/289; 248/354.2

See application file for complete search history.

(56) References Cited

U.S. PATENT DOCUMENTS

| | | | | |
|---|---|---|---|---|
| 2,990,166 | A * | 6/1961 | Walsh | 299/11 |
| 3,937,025 | A * | 2/1976 | Alvarez-Calderon | 405/267 |
| 4,072,015 | A * | 2/1978 | Morrell et al. | 405/289 |
| 4,770,564 | A * | 9/1988 | Dison | 405/288 |
| 4,983,077 | A * | 1/1991 | Sorge et al. | 405/288 |
| 5,143,340 | A | 9/1992 | Wood | |
| 5,469,920 | A * | 11/1995 | Conti et al. | 169/48 |
| 5,615,979 | A | 4/1997 | Lin | |
| 5,921,718 | A * | 7/1999 | Kolk | 405/290 |
| 6,394,707 | B1 * | 5/2002 | Kennedy et al. | 405/288 |
| 6,547,492 | B1 * | 4/2003 | Degville | 405/289 |
| 6,558,085 | B1 * | 5/2003 | Hall | 405/288 |

FOREIGN PATENT DOCUMENTS

| | | | |
|---|---|---|---|
| JP | 63060320 | A | 3/1988 |
| JP | 11217825 | A | 8/1999 |
| JP | 11217826 | A | 8/1999 |
| JP | 2004076568 | A | 3/2004 |

* cited by examiner

*Primary Examiner* — John Kreck
*Assistant Examiner* — Benjamin Fiorello
(74) *Attorney, Agent, or Firm* — Dilworth & Barrese, LLP

(57) ABSTRACT

A grout bag assembly (1) is provided comprising an inflatable grout bag (2, 26, 34, 40) having a top (4, 42), bottom (6) and generally cylindrical sidewall (8) with an inlet (10) for fluent settable grout material. An inner bag (14, 28, 38) is attached to the grout bag such that upon filling of the grout bag the inner bag forms a generally axially extending separate compartment (18) within the grout bag. The inner bag preferably has a separate inlet (20) accessible from the exterior of the grout pack after the grout bag has been installed. The inner bag is generally attached to the inside of the grout bag such that a space of optionally varying radial size is formed between the inner surface of the grout bag and the outer surface of the inner bag.

14 Claims, 3 Drawing Sheets

MINE SUPPORT GROUT BAGS AND GROUT PACKS

FIELD OF THE INVENTION

This invention relates to a grout bag and grout pack of the type used as a hanging wall support in underground mining operations in order to support the roof or hanging wall relative to the footwall. More particularly, the invention relates to a grout bag used for containing granular material that may be set solid using cementitious or other suitable binding material to form a so-called grout pack.

In this specification the term "grout bag" is intended to have its widest meaning and to include any appropriate enclosure made of a membrane in the form of a flexible sheet material for the purpose of containing granular, including solidified granular, material serving as a mine roof or hanging wall support, in use. The term "grout pack" is intended to mean a grout bag used for containing granular material that may be set solid using cementitious or other suitable binding material to form a so-called grout pack typically, but not necessarily, strengthened with external restraining rings or metal mesh encircling the grout bag and restraining the grout bag against lateral deformation or excessive bulging during installation and under subsequent axial load.

BACKGROUND TO THE INVENTION

The support of the hanging wall in stopes is one of the most basic requirements in underground mining operations. Dependant on the type and quality of rock being supported, the depth of mining, the prevalent field stresses, seismicity, stoping width and a number of other factors, underground mine roof support can vary across a vast range of materials, configurations and systems. These include, amongst others, timber poles, timber and composite packs, steel props, unmined ore pillars, rock anchors and granular or tailings type supports.

Among granular support media, cemented grout packs are increasingly being used as combination support products. These consist essentially of a support column formed by cured cemented backfill or other suitable cured cementitious grout which is contained within a geotextile bag and generally stiffened with external restraining rings or metal mesh against lateral deformation or bulging during installation and when yielding under subsequent axial load.

Conventional grout bags are essentially closed geotextile containers, typically made of woven ribbons and monofilaments of polyethylene and polypropylene to provide required filtering characteristics to retain solid particles whilst allowing excess liquid to escape. Of course, it is also possible that the grout bag could be water impervious any event that the unset cementitious grout is sufficiently devoid of any excess moisture. The bag has some form of unidirectional valve for inflating it with slurry under pressure. The bags also typically have some means of suspending them on support structures within the stopes using ties or loops to facilitate their installation. Once the bags have been inflated with slurry, typically as a grout, the material needs to cure or set to develop sufficient strength to carry load.

However, not all grades of tailings are suitable for use as grout for inflating such a grout bag and, in particular, the fines or slimes as they may be termed would, if they could be used practically, require uneconomical amounts of cementitious material to be admixed therewith. Accordingly, the use of grout bags to form grout packs, whilst it does assist in the disposal of some of the tailings generated consequent on the mining operations, it does not assist as regards the disposal of tailings having a fine particle size.

OBJECT OF THE INVENTION

It is an object of this invention to provide an underground support of the general nature of a grout bag or grout pack which may, at least to some extent, alleviate the difficulty of disposing of tailings that are unsuitable for use in a grout mixture used for forming grout packs.

SUMMARY OF THE INVENTION

In accordance with this invention there is provided a grout bag assembly comprising an inflatable grout bag having a top, bottom and generally cylindrical sidewall with an inlet for fluent settable grout material, the grout bag having, in an expanded condition, an axis extending between the top and bottom thereof, the grout bag assembly being characterised in that the grout bag has an inner bag attached thereto wherein the grout bag and inner bag are arranged such that upon filling of the grout bag the inner bag forms a generally axially extending separate compartment within the grout bag.

Further features of the invention provide for the inner bag to have a separate inlet accessible from the exterior of the grout pack; for the inner bag to be attached to the inside of the grout bag such that a space of optionally varying radial size is formed between the inner surface of the grout bag and the outer surface of the inner bag, the inner bag optionally being attached to the grout bag by an operatively upwardly extending tie arrangement at angularly spaced positions around the cylindrical sidewall wherein each tie arrangement is preferably provided with apertures enabling fluent settable grout material to flow through the tie arrangement; for the grout bag itself to have at least a sidewall that is permeable to liquid so that excess water or the like contained in fluent settable grout material can drain through the sidewall that may, for example, be a geotextile material; and for the inner bag to be made of a liquid impermeable material so that it may be used to contain a slurry having a liquid component which may be harmful to the set grout material in the grout bag, or harmful if it is allowed to be released into a stope or other environment in which the grout pack is installed, in use.

Still further features of the invention provide for each of the grout bag and inner bag have a unidirectional valve-controlled inlet; and for a reinforcing structure in the form of external restraining rings and/or metal or other mesh to be provided around the grout bag to control bulging thereof in use and further to control collapse of a grout pack during the yielding process.

In order that the invention may be more fully understood, different embodiments thereof will now be described with reference to the accompanying drawings.

DETAILED DESCRIPTION WITH REFERENCE TO THE DRAWINGS

Figure 1:
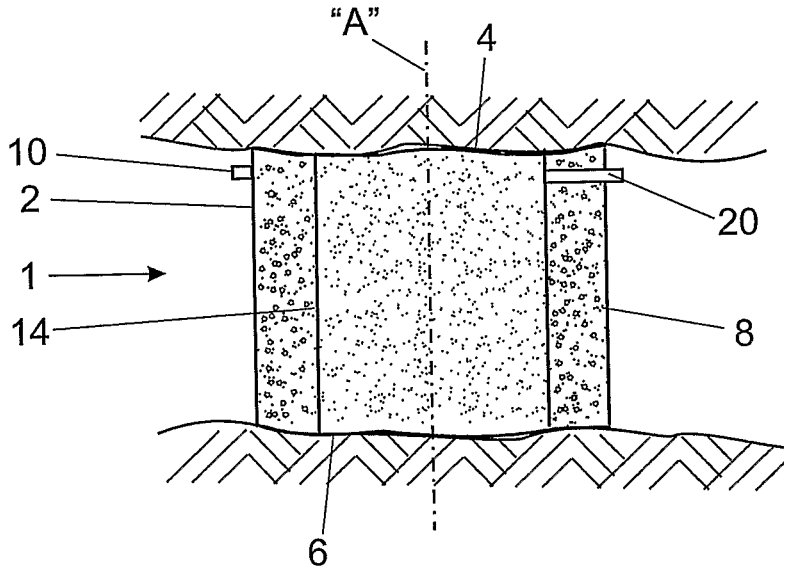
FIG. 1 a schematic sectional elevation of one embodiment of grout bag assembly or grout pack according to the invention in the installed condition between a hanging wall and a footwall being typical of a large diameter of grout bag assembly.

In the embodiment of the invention illustrated in FIGS. 1 to 4 of the drawings, a grout bag assembly, generally indicated by numeral (1), includes a grout bag (2) made of a water permeable geotextile material that is adapted to retain a grout comprising granular material and a binder introduced into it but to allow excess water to drain away from the grout material. Of course, should the composition of the fluent settable grout material be appropriate, the grout bag could be impervious to water. In either event, the grout bag has a generally circular cylindrical shape with a top (4), bottom (6) and sidewall (8). A unidirectional valve-controlled inlet (10) is provided in the sidewall (8) near the top (4) in conventional fashion.

The general construction of the grout bag and the materials used may be the same as those used currently for existing grout bags and the details need not be further described herein. The maximum height of such a bag taken along its axis "A" will depend on the height of the hanging wall to be supported and is typically in the range of about 800 mm to 1500 mm.

As provided by this invention, an inner bag (14) is located generally coaxially within the grout bag to extend up the entire operative height thereof and is attached to the grout bag by a tie arrangement (16) at equally angularly spaced positions, in this instance seven different positions, around the cylindrical sidewall. The tie arrangement generally assumes the form of a suitable strip of material that has apertures to enable fluent settable grout material to flow through it so that filling of the entire grout bag can take place by way of the single inlet valve (10). This arrangement is such that the inner bag forms a generally axially extending separate inner compartment (18) within the grout bag when the grout bag is filled by way of the inlet valve (10). A valve controlled inlet duct (20) bridges the gap between the sidewall of the grout bag and the inner bag to provide an inlet to the interior of the separate inner compartment (18) formed by the inner bag.

The inner bag is, in this instance, made of a liquid impermeable sheet material so that it may be used to contain a slurry or liquid component which may be harmful to the set grout material in the grout bag, or, alternatively, harmful in one way or another if it is allowed to be released into an operations area such as a stope or other environment in which the grout pack is installed. A suitable material for the inner bag is considered to be a fabric reinforced PVC or other suitable waterproof material.

Figure 2:
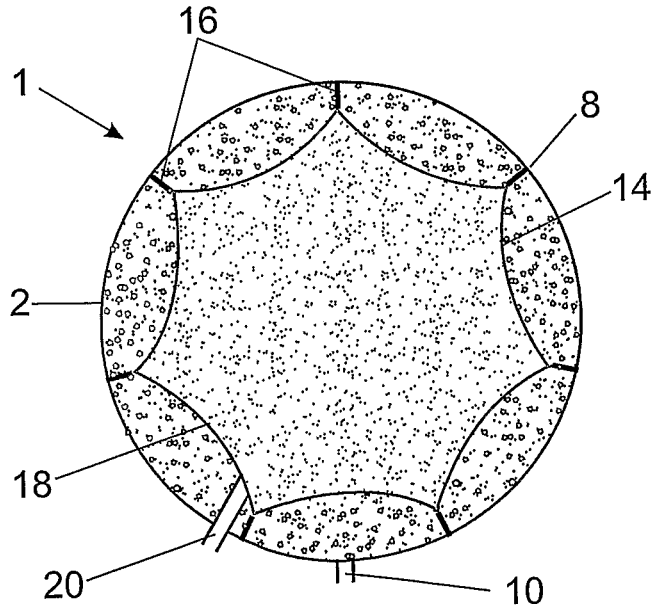
FIG. 2 is a schematic sectional plan view of the embodiment of the invention illustrated in FIG. 1.
Figure 3:
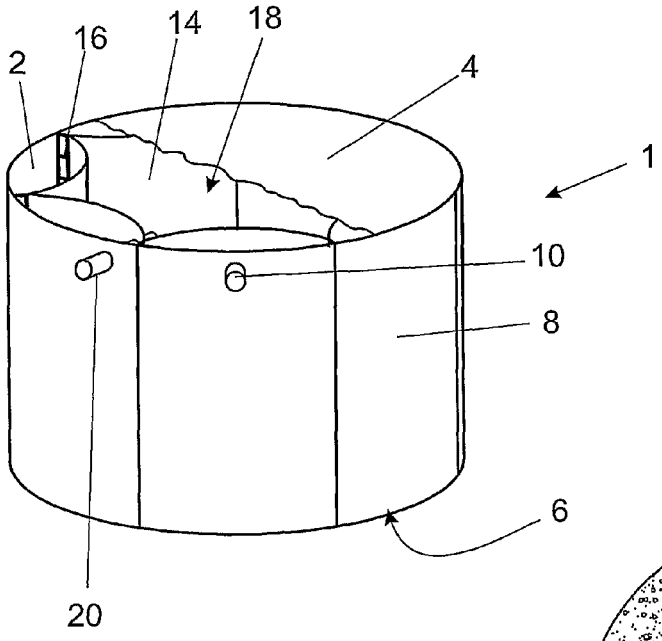
FIG. 3 is a schematic isometric view of the grout bag assembly illustrated in FIGS. 1 and 2 with the top thereof partly broken away.

With the arrangement illustrated in FIGS. 1 to 4, the flexible sheet material of the inner bag is largely unsupported between the series of ties and, this being so, when the grout bag itself is filled with fluent settable grout material, the inner bag bulges inwards between the upwardly extending tie arrangements to provide a tubular grout wall that varies angularly in radial dimension and, in fact, forms segments of double convex shape in section, as shown clearly in FIG. 2.

It will be noted that the fluid grout, during introduction thereof can flow freely past the tie arrangement to fill the entire space between the grout bag sidewall and the inner bag.

After initial installation of the grout bag in the manner indicated above, the settable grout material is allowed to set prior to introducing any slurry or other fluid material into the inner bag by way of the valve controlled inlet duct (20). The material introduced into the inner bag will generally not be structural in any way as it will typically contain extremely fine tailings, typically of the type often referred to as slimes.

Figure 4:
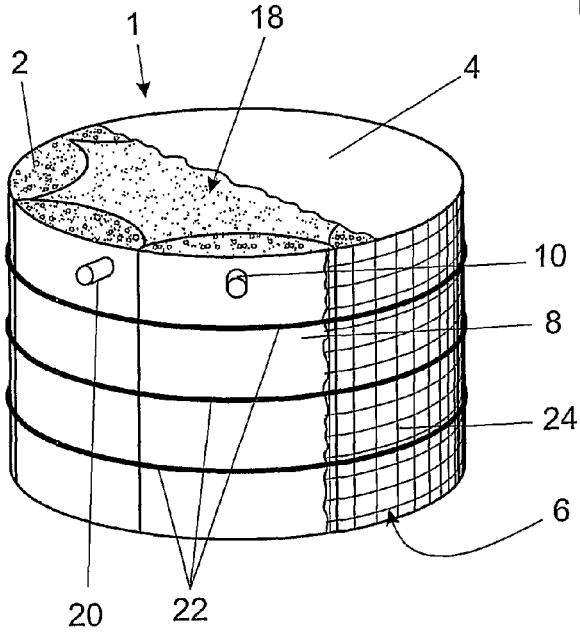
FIG. 4 is the same as FIG. 3 but shows the grout material present within the grout bag and unset slurry material within the inner bag.

As shown in FIG. 4, an external reinforcing structure in the form of axially spaced external restraining rings (22) or metal or other mesh (24) may be provided around the grout bag, as may be determined according to requirements, to control outwards bulging thereof in use and further to control collapse of a grout pack during the yielding process.

As indicated above, the embodiment of the invention illustrated in FIGS. 1 to 4 is a generally larger type and the attachment of the inner bag to the grout bag could vary considerably, particularly as regards the number of positions of the tie arrangements or other attachments used for locating the inner bag relative to the grout bag.

Figure 5:
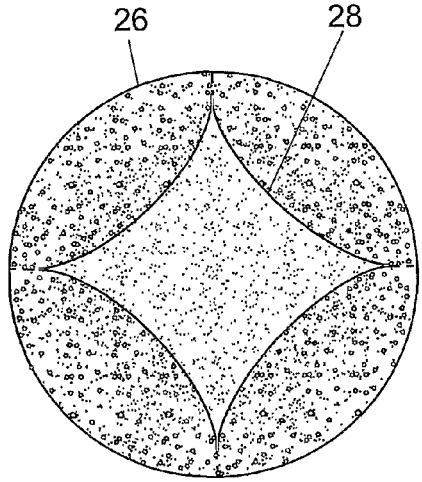
FIG. 5 is a view similar to FIG. 2 but showing a smaller diameter grout bag assembly with the inner bag attached to the grout bag at fewer peripheral regions thereof.

FIG. 5 illustrates, simply by way of example, a typically smaller diameter of grout bag (26) in which the inner bag (28) is attached to the inside of the grout bag at only four different equally angularly spaced positions around the periphery thereof.

Figure 6:
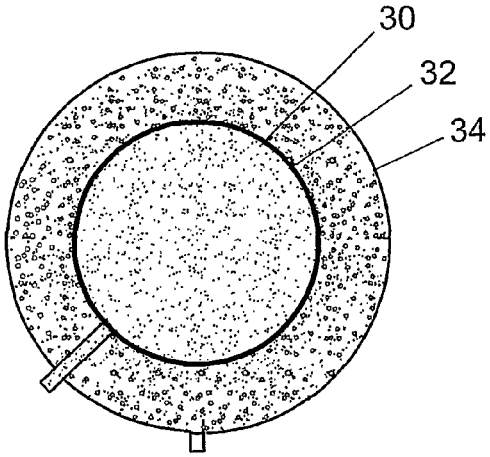
FIG. 6 is a schematic plan view of an embodiment of the invention in which the inner bag is provided with axially spaced internal strengthening rings.
Figure 7:
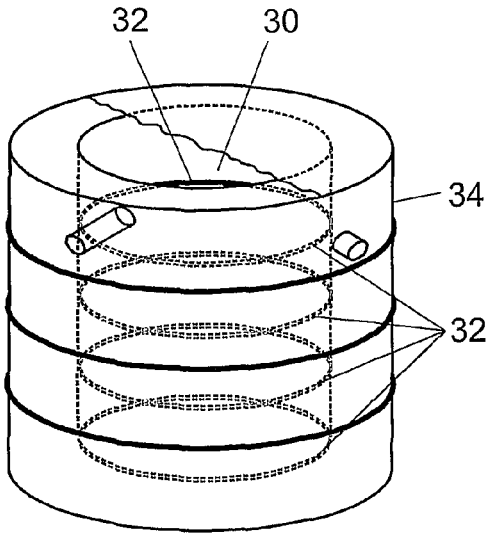
FIG. 7 is a schematic isometric illustration thereof.

Turning now to the embodiment of the invention illustrated in FIGS. 6 and 7, in this instance the inner bag (30) is supported against inward bulging of the type described with reference to FIGS. 1 to 4 by means of a series of vertically spaced internal compression rings (32) that confine the inner tube to a substantially right circular cylindrical shape when fluent settable grout material is introduced into the grout bag. The space between the grout bag (34) and the inner bag (30) is therefore of substantially annular shape as illustrated clearly in FIG. 6.

Figure 8:
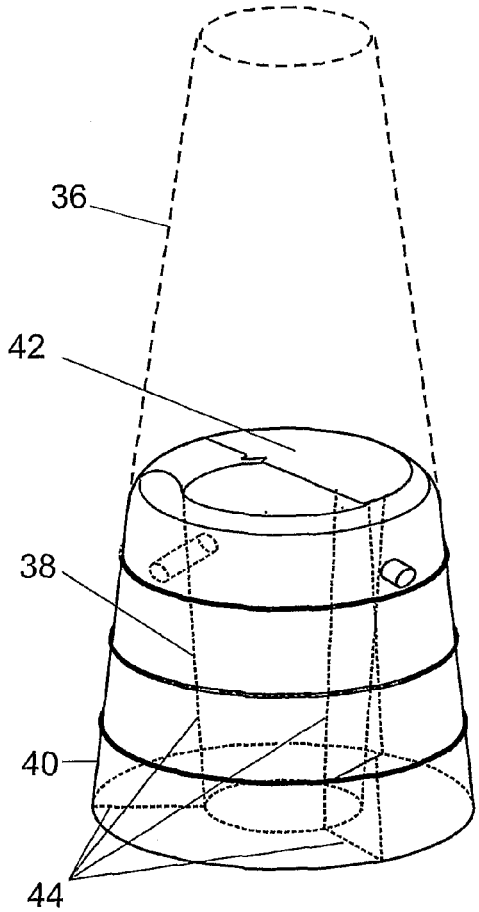
FIG. 8 is a schematic isometric view illustrating an alternative way in which the inner and outer bags can be formed using a single structure of flexible sheet material.

Finally, turning to the embodiment of the invention illustrated in FIG. 8, it is possible to make the grout bag and inner bag as a single unit of tapering shape, typically truncated conical shape as illustrated in dotted lines (36), so that could the smaller diameter portion indicated by numeral (38) can be folded inwards coaxially with a larger diameter portion (40) so that the latter forms the outer wall of the grout bag itself and the former forms the inner bag wall that separates the grout bag from the inner compartment. In this instance a separate top (42) is secured to the outside of the single unit at the point of transition between the larger and smaller diameter portions.

It will be understood that the latter arrangement will only be suitable in instances in which the wall thickness of the settable grout material contained between the larger diameter outer portion or grout bag itself and smaller diameter inner portion or inner bag will decrease from the bottom upwards and, accordingly, the strength of the grout and its yielding characteristics will be commensurate with the variation in wall thickness and the manner of installation. In particular, in the event that the distance between a hanging wall and footwall at the position of installation is appreciably less than one half of the overall length of the truncated conical unit, a finite wall thickness is achieved at the point of transition between the grout bag defining portion and inner bag defining portion.

Of course, tie arrangements (44) will nevertheless be required to locate the inner portion relative to the outer portion, particularly in the region where the largest diameter and smallest diameter define the largest annular cross-section of the resultant grout pack.

Numerous other variations and embodiments of the invention are possible without departing from the scope hereof.

The invention claimed is:

1. A grout bag assembly comprising an inflatable grout bag having a top, bottom and a generally cylindrical sidewall with an inlet for fluent settable grout material, the grout bag having, in an expanded condition, an axis extending between the top and bottom thereof, wherein the grout bag has an inner bag attached thereto wherein the grout bag and inner bag are arranged such that upon filling of the grout bag the inner bag forms a generally axially extending separate compartment within the grout bag, and the inner bag is attached to the grout bag by an operatively upwardly extending tie arrangement at angularly spaced positions around the cylindrical sidewall wherein each tie arrangement is provided with apertures enabling fluent settable grout material to flow through the tie arrangement.

2. The grout bag assembly as claimed in claim 1 in which the inner bag has a separate inlet accessible from the exterior of the grout bag assembly.

3. The grout bag assembly as claimed in claim 2 in which the inner bag is attached to the inside of the grout bag such that a space of optionally varying radial size is formed between the inner surface of the grout bag and the outer surface of the inner bag.

4. The grout bag assembly as claimed in claim 3 in which the grout bag itself has at least a sidewall that is permeable to liquid so that excess water or the like contained in fluent settable grout material can drain through the sidewall.

5. A grout bag assembly as claimed in dam 4 in which the inner bag is made of a liquid impermeable material.

6. The grout bag assembly as claimed in claim 2 in which the grout bag itself has at least a sidewall that is permeable to liquid so that excess water or the like contained in fluent settable grout material can drain through the sidewall.

7. The grout bag assembly as claimed in claim 6 in which the inner bag is made of a liquid impermeable material.

8. The grout bag assembly as claimed in claim 1 in which the inner bag is attached to the inside of the grout bag such that a space of optionally varying radial size is formed between the inner surface of the grout bag and the outer surface of the inner bag.

9. The grout bag assembly as claimed in claim 8 in which the grout bag itself has at least a sidewall that is permeable to liquid so that excess water or the like contained in fluent sellable grout material can drain through the sidewall.

10. The grout bag assembly as claimed in claim 9 in which the inner bag is made of a liquid impermeable material.

11. The grout bag assembly as claimed in claim 1 in which the grout bag itself has at least a sidewall that is permeable to liquid so that excess water or the like contained in fluent settable grout material can drain through the sidewall.

12. The grout bag assembly as claimed in claim 1 in which the inner bag is made of a liquid impermeable material.

13. The grout bag assembly as claimed in claim 1 in which each of the grout bag and inner bag has a unidirectional valve-controlled inlet.

14. The grout bag assembly as claimed in claim 1 in which a reinforcing structure selected from external restraining rings and mesh is provided around the grout bag to control bulging thereof in use and collapse of a grout pack during yielding thereof.

* * * * *